US011382808B2

(12) United States Patent
Schroeder et al.

(10) Patent No.: US 11,382,808 B2
(45) Date of Patent: Jul. 12, 2022

(54) WHEELCHAIR

(71) Applicant: OTTO BOCK MOBILITY SOLUTIONS GMBH, Konigsee-Rottenbach (DE)

(72) Inventors: Julia Schroeder, Illmenau (DE); Dirk Moeller, Hennef (DE); Sascha Hohendorn, Gehren (DE); Jens Dittmar, Ilmtal OT Griesheim (DE); Johannes Koenig, Gotha (DE)

(73) Assignee: OTTO BOCK MOBILITY SOLUTIONS GMBH, Konigsee-Rottenbach (DE)

( * ) Notice: Subject to any disclaimer, the term of this patent is extended or adjusted under 35 U.S.C. 154(b) by 529 days.

(21) Appl. No.: 16/335,374

(22) PCT Filed: Sep. 7, 2017

(86) PCT No.: PCT/EP2017/072489
§ 371 (c)(1),
(2) Date: Mar. 21, 2019

(87) PCT Pub. No.: WO2018/054694
PCT Pub. Date: Mar. 29, 2018

(65) Prior Publication Data

US 2021/0282987 A1 Sep. 16, 2021

(30) Foreign Application Priority Data

Sep. 23, 2016 (DE) ..... 102016118037.8

(51) Int. Cl.
*A61G 5/04* (2013.01)
*A61G 5/10* (2006.01)

(52) U.S. Cl.
CPC ..... *A61G 5/043* (2013.01); *A61G 5/1078* (2016.11)

(58) Field of Classification Search
CPC ..... A61G 5/04; A61G 5/043; A61G 5/1078; A61G 5/1089
See application file for complete search history.

(56) References Cited

U.S. PATENT DOCUMENTS 6,134,748 A * 10/2000 Kuo ..... B60B 33/06 16/34
6,428,022 B1 * 8/2002 Namiki ..... A63C 17/01 280/268

(Continued)

FOREIGN PATENT DOCUMENTS

DE 102006035490 A1 3/2008
DE 202010005233 U1 9/2010

(Continued)

OTHER PUBLICATIONS

PCT International Search Report for PCT International Patent Application No. PCT/EP2017/072489, dated Dec. 12, 2017.

*Primary Examiner* — Frank B Vanaman
(74) *Attorney, Agent, or Firm* — Holland & Hart LLP

(57) ABSTRACT

A wheelchair having a chassis on which the following are arranged, opposite one another: at least one drive unit comprising a drive wheel and an electric drive system, a front wheel positioned on a front swivel arm, and a rear wheel. The drive unit and front swivel arm are arranged so as to pivot relative to the chassis in a vertical plane, and are coupled to one another by a first coupling and a second coupling member.

27 Claims, 20 Drawing Sheets

(56) References Cited

U.S. PATENT DOCUMENTS

| | | | | |
|---|---|---|---|---|
| 9,308,143 | B2 | 4/2016 | Bekoscke et al. | |
| 2005/0000742 | A1 | 1/2005 | Mulhern et al. | |
| 2005/0077694 | A1* | 4/2005 | Levi | A61G 5/06 280/47.16 |
| 2005/0127631 | A1 | 6/2005 | Schaffner | |
| 2006/0201723 | A1 | 9/2006 | Hsu et al. | |
| 2007/0039766 | A1* | 2/2007 | Jackson | A61G 5/043 180/65.1 |
| 2007/0252354 | A1* | 11/2007 | Chen | A63C 17/12 280/87.042 |
| 2008/0264702 | A1 | 10/2008 | Cheng | |
| 2011/0012316 | A1* | 1/2011 | Cheng | A61G 5/1078 280/5.514 |
| 2013/0207364 | A1 | 8/2013 | Bekoscke et al. | |
| 2018/0008493 | A1* | 1/2018 | Danielsson | A61G 5/1078 |

FOREIGN PATENT DOCUMENTS

| | | | |
|---|---|---|---|
| DE | 102015101552 | A1 | 8/2016 |
| WO | 9615752 | A1 | 5/1996 |

* cited by examiner

21
F
3
8
5

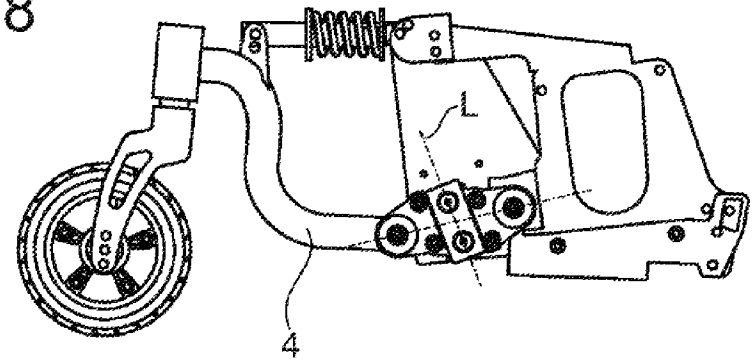
Fig. 8
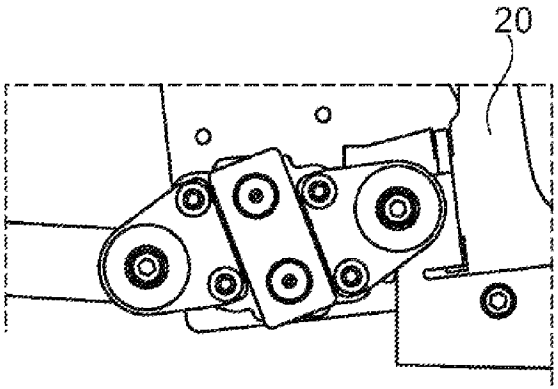
Fig. 9
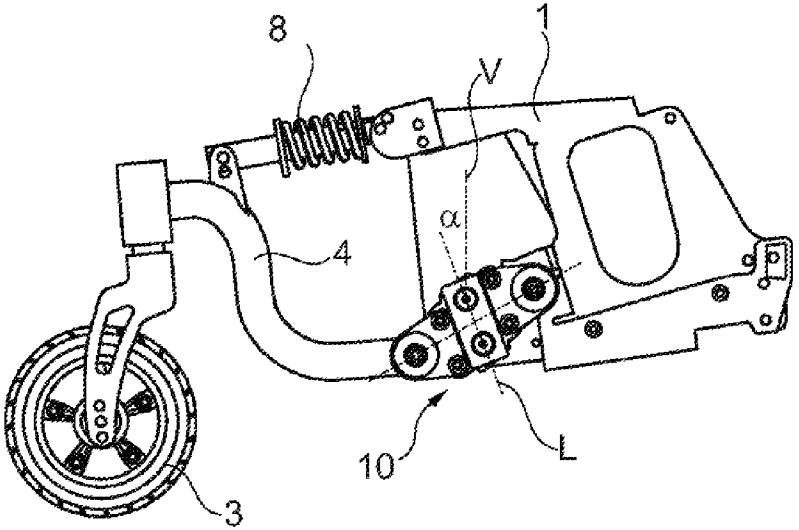
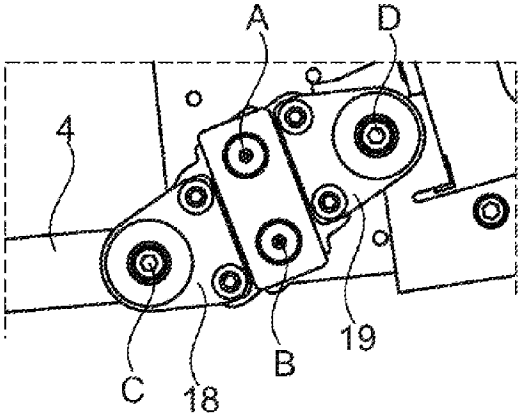

WHEELCHAIR

TECHNICAL FIELD

The invention relates to a wheelchair having a chassis on which there are arranged opposite each other at least one drive unit which has a drive wheel and an electric drive, a front wheel which is arranged on a front pivot arm and a rear wheel and the drive unit and the front pivot arm are pivotably arranged in a vertical plane relative to the chassis and are connected to each other by a first coupling means.

BACKGROUND

Such a six-wheel wheelchair is, for example, known from U.S. Pat. No. 9,308,143 B2. The coupling of the drive unit and front pivot arm can be carried out by means of a spring/damper unit. This unit is supported in an articulated manner at both of the ends thereof, wherein the bearing locations are arranged with respect to each other in such a manner that, when the wheelchair travels on a straight horizontal plane, the main portion of the force applied by the spring/damper unit acts on the drive wheel in order obtain good traction.

A wheelchair having a central wheel drive is distinguished by a very small turning circle. As a result of the fact that the center of gravity, that is to say, the body rotation point, of the user is located above the drive axis, this wheelchair can also be driven in the tightest of spaces. Furthermore, such a wheelchair also provides optimum traction as a result of the weight distribution. As a result of the coupling of the front pivot arm to the drive, when travelling over obstacles, such as, for example, pavement edges, only small movements are introduced into the seat and consequently into the driver.

SUMMARY

An object of the invention is to improve the known wheelchair in terms of its travel properties and in terms of its ability to mount curbs.

The object is achieved in that the drive unit and the front pivot arm are additionally connected to each other by a second coupling means.

As a result of the second coupling means, it is possible to decouple the front wheel and drive unit at two locations so that, as a result of the additional possibility of decoupling, fewer hard impacts when driving over an uneven substrate (paving stone) reach the drive carrier and consequently the seat of the wheelchair. The driving behavior consequently becomes substantially more pleasant for the user, which in particular for the most severely disabled users is a significant gain in terms of comfort.

The front and/or the rear wheel may be a steering wheel.

DE 20 2010 005 233 U1 discloses a generic electric wheelchair which has a drive frame which receives the drive unit, a front wheel frame and a chassis. Between the front wheel frame and the drive frame a front bumper is provided as a single coupling means. An auxiliary bumper is arranged between the drive frame and the chassis. When travelling over an obstacle, the front wheel pivots upward, wherein the front bumper is pressed together and forces the drive frame onto the substrate, whereby the tension spring in the auxiliary bumper is tensioned.

US 2005/0127631 A1 and US 2008/0264702 A1 disclosed electric wheelchairs in which the front pivot arm with the drive unit are connected to each other by means of a bumper as a coupling means.

The first and/or second coupling means may be a spring and/or damper unit. When the second coupling means is a spring and/or damper unit, it may be completely sufficient for the first coupling means to be formed by a rigid connection rod or the like.

Preferably, the second coupling means is a swing arm which is secured to the chassis so as to be able to be pivoted about a first pivot axis A and a second pivot axis B and in which the front pivot arm is pivotably supported about a third pivot axis C and the drive unit is pivotably supported about a fourth pivot axis D.

When the first pivot axis A and the second pivot axis B are located on a notional line which extends with respect to the vertical at an angle $\alpha$ of from 0° to 45°, there is produced a parallelogram of the pivot locations which leads to the pivot locations of the pivot arm and the drive unit being variable both in their horizontal position and in their vertical position, therefore the position thereof changing during a movement.

The swing arm is preferably formed by two opposing yokes which are connected to each other by means of at least one upper plate which receives the first pivot axis A and at least one lower plate which receives the second pivot axis B.

Each yoke can be formed by two plates which are arranged in a parallel manner and which can be constructed in a substantially triangular manner and which are connected to each other by means of a bolt.

In this instance, it is advantageous for each plate which forms the yoke to be connected to an upper plate and a lower plate and for the upper plates to be connected by means of a first bolt and the lower plates to be connected by means of a second bolt. The first and the second bolts may be constructed identically.

The upper plate and lower plate may be resiliently supported in a housing which is secured to the chassis. The upper plate and the lower plate may also be resiliently connected to each other. Such a connection can be produced, for example, by means of at least one resilient element, which in particular may be a torsion spring.

The connection of the upper plate to the lower plate may, however, also be carried out by means of at least one element which comprises an elastomer material (for example, a rubber buffer).

Preferably, the rear wheel is also arranged on a rear pivot arm which is pivotably connected to the chassis. If a third spring/damper unit is arranged between the rear pivot arm and the chassis, excessive oscillations when travelling over uneven ground are effectively prevented from being introduced into the chassis.

The rear pivot arm and the drive unit are preferably not coupled to each other in terms of their movements.

Preferably, the third pivot axis is arranged at one side of the notional line and the fourth pivot axis is arranged at the opposite side of the notional line.

If the third pivot axis is arranged lower with respect to a substrate on which the wheels are standing, that is to say, the carriageway, than the fourth pivot axis, the introduction of the movement into the front pivot arm or the drive unit is carried out gently.

Preferably, the resilient means are provided in the swing arm at the articulation location of the front pivot arm. The resilient means may also be arranged in the swing arm at the articulation location of the drive unit, wherein the resilient means may be arranged both at the articulation location of the pivot arm and at the articulation location of the drive unit.

In a preferred embodiment, the resilient means surround the first and the second pivot axes.

If the first and second bolts have at least two diametrically arranged projections and the resilient means surround the first and second pivot axes, the upper and lower plates which connect the two yokes can pivot.

Preferably, the projections are embedded in the element which comprises an elastomer material.

The upper plate may be connected to the lower plate in a preferred embodiment by means of two resilient elements. The first resilient element can then be arranged in the region of the third pivot axis and the second resilient element can then be arranged in the region of the fourth pivot axis.

The wheelchair preferably has a seat and in a preferred embodiment a pivot arm may be formed on the drive unit. Preferably, the seat is arranged on the chassis.

BRIEF DESCRIPTION OF THE DRAWINGS

Embodiments of the invention are intended to be described in greater detail below with reference to a wheelchair and drawings. In the drawings:

FIG. 8 is a partial illustration of the wheelchair;

FIG. 9 is an enlarged illustration from FIG. 8;

DETAILED DESCRIPTION

Figure 1:
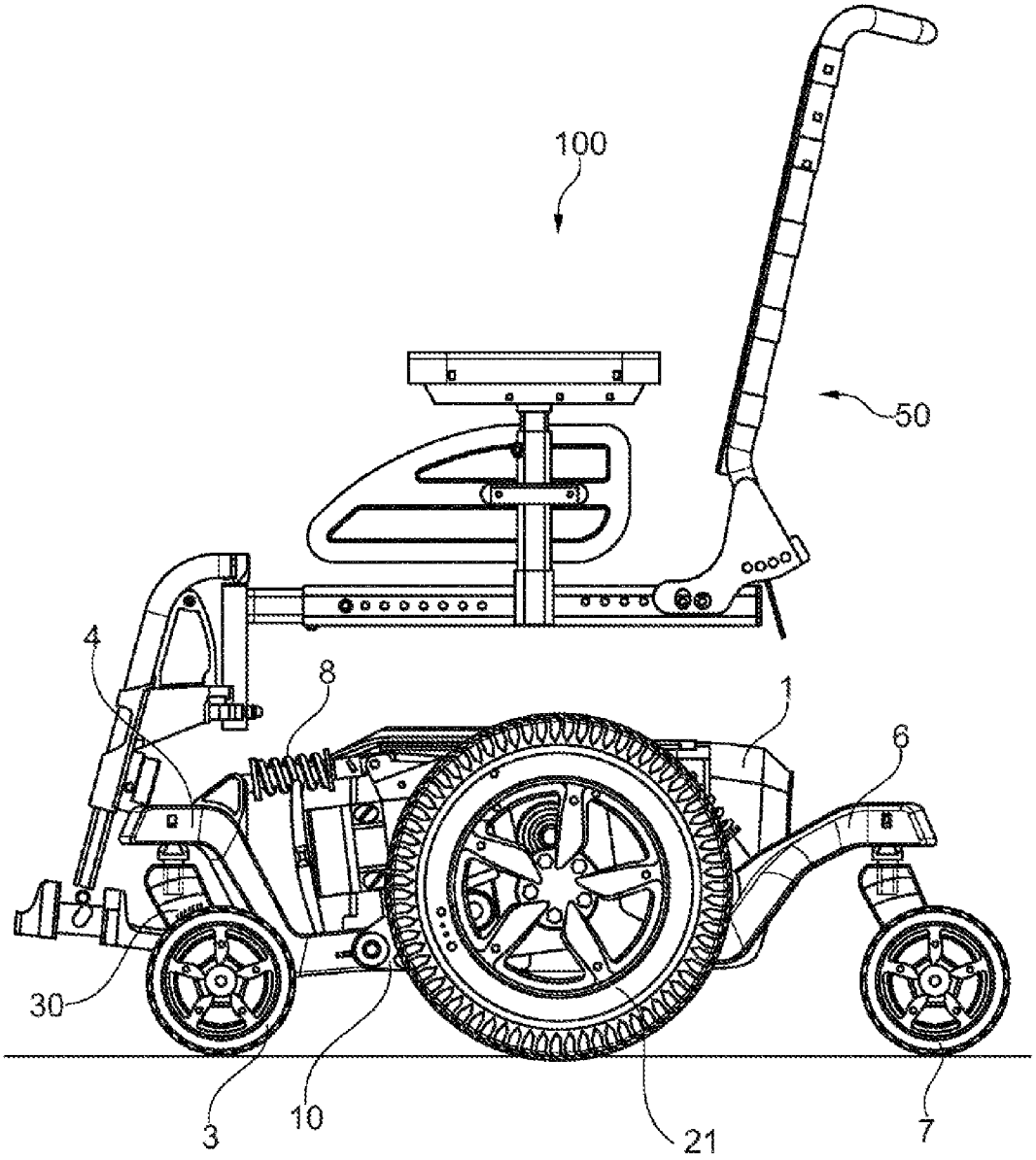
FIG. 1 is a simplified side view of a wheelchair.

The wheelchair 100 substantially comprises the seat 50 which is arranged on the chassis 1, the drive wheels 21 which are arranged at both sides on the chassis 1, the front steering wheels 3 and the rear support wheels 7. Since the arrangement and suspension of the wheels 3, 21, 7 is symmetrical to the left and right of the chassis 1, the subsequent description is carried out only with reference to a single-sided construction. For the opposing portion, this then applies accordingly. The front steering wheel 3 is rotatably supported in a fork 30 about a horizontal axis. The fork 30 is rotatably arranged about a vertical axis in the front pivot arm 4. The support wheel 7 is arranged on a rear pivot arm 6, which is pivotably fitted to the chassis 1 and which is supported via a spring/damper unit 9 on the chassis 1. The drive unit 20 which drives the drive wheel 21 is connected via a spring/damper unit 8 to the front pivot arm 4. Another connection between the drive unit 20 and front pivot arm 4 is carried out via a second spring/damper unit 10 which is pivotably secured to the chassis 1 about a first pivot axis A and a second pivot axis B. The front pivot arm 4 is pivotably supported about a third pivot axis C in the spring/damper unit 10 and the drive unit 20 is pivotably supported about a fourth pivot axis D in the spring/damper unit 10.

Figure 2:
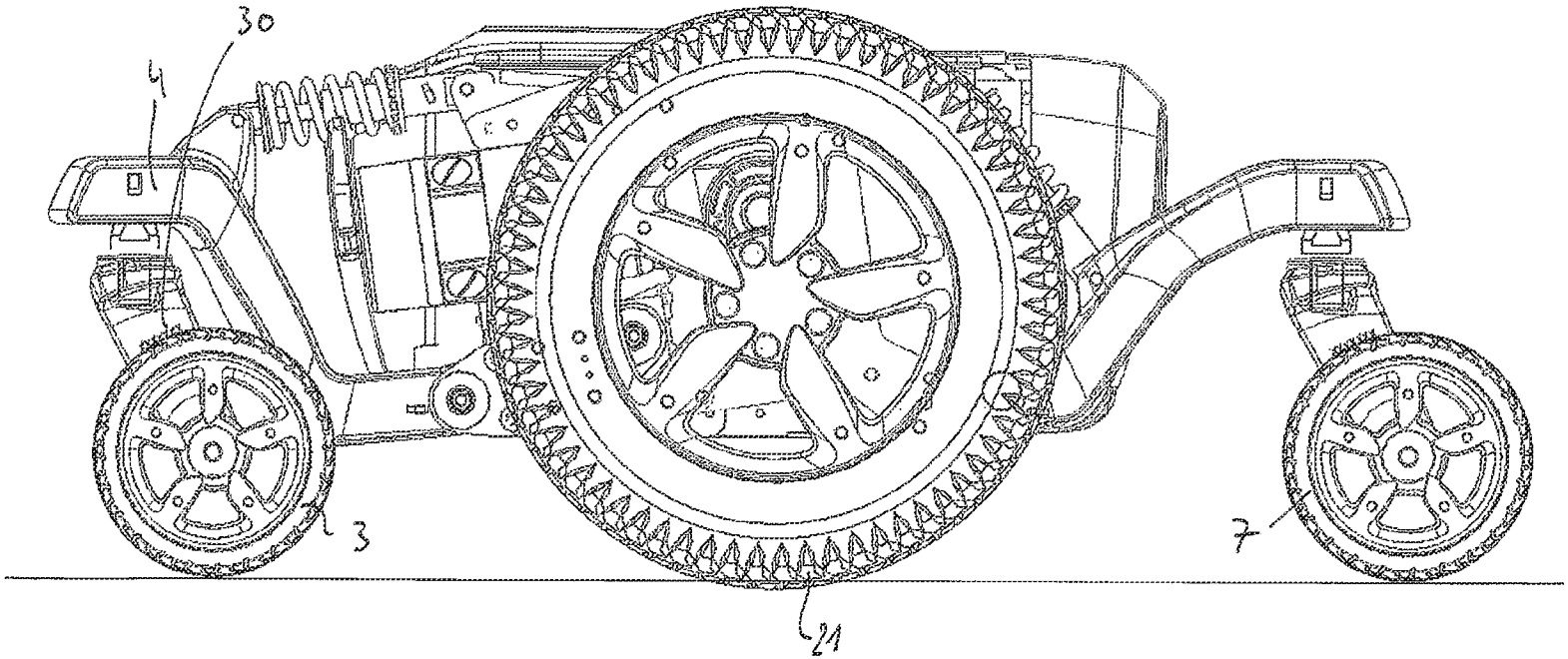
FIG. 2 is a cut-out of FIG. 1.
Figure 3:
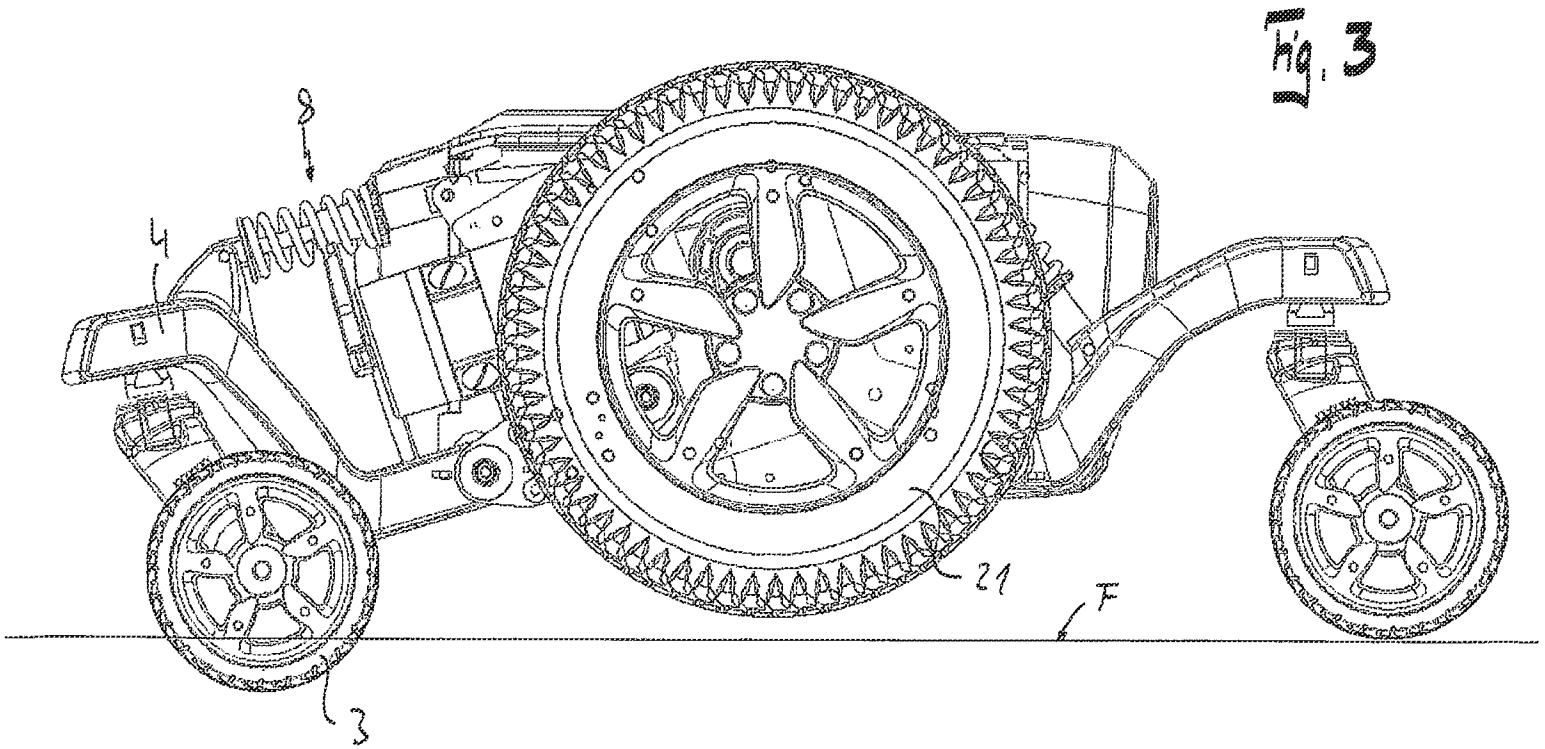
FIG. 3 shows the illustration according to FIG. 2 with a lowered steering wheel.
Figure 4:
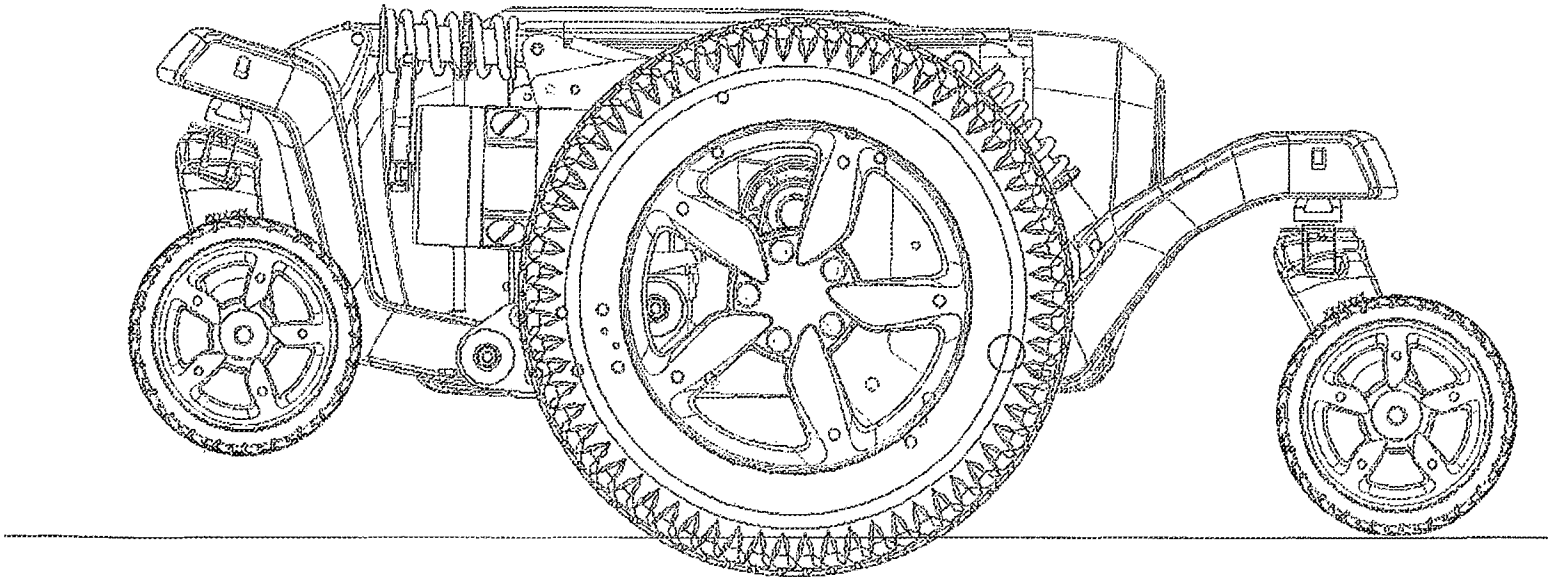
FIG. 4 shows the illustration according to FIG. 2 with a raised steering wheel.
Figure 5:
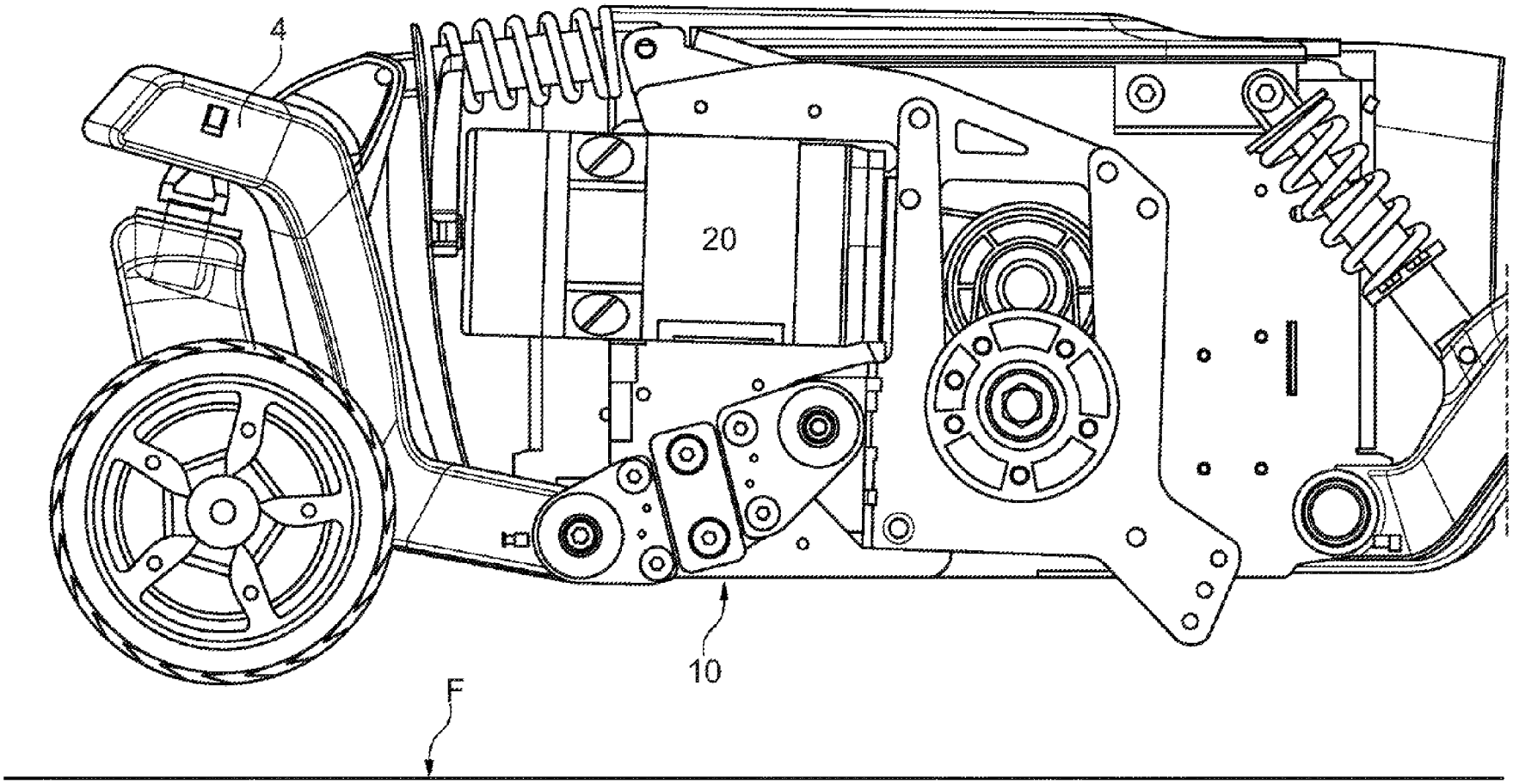
FIG. 5 is an enlarged illustration from FIG. 4 without a drive wheel.
Figure 7:
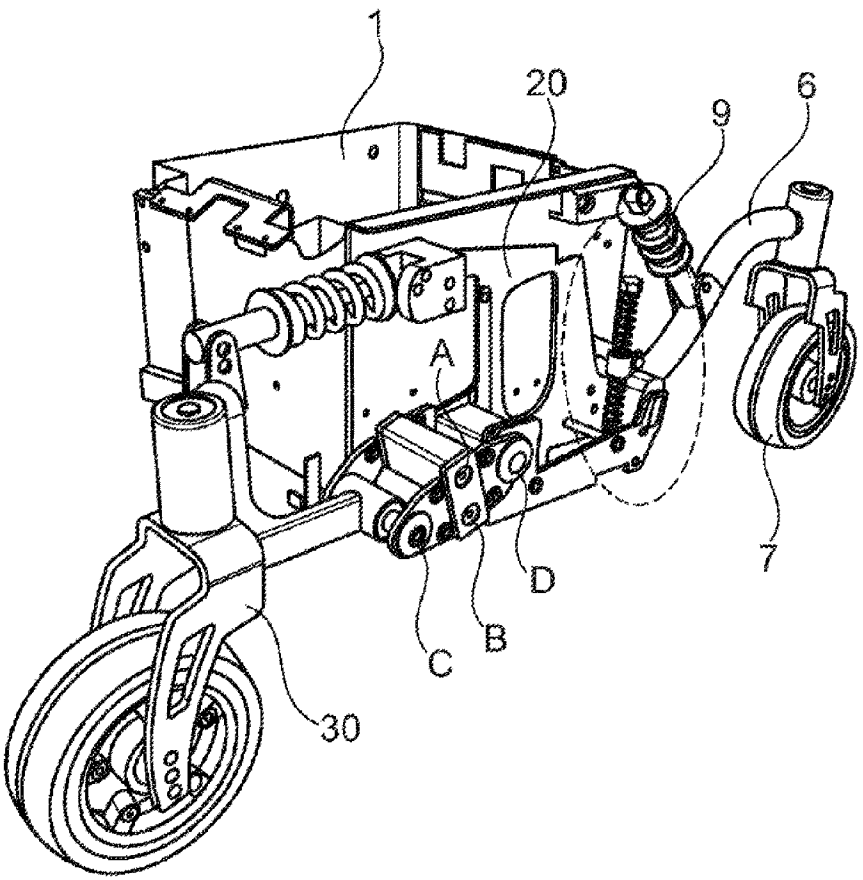
FIG. 7 is a second perspective part-illustration of a wheelchair.
Figure 6:
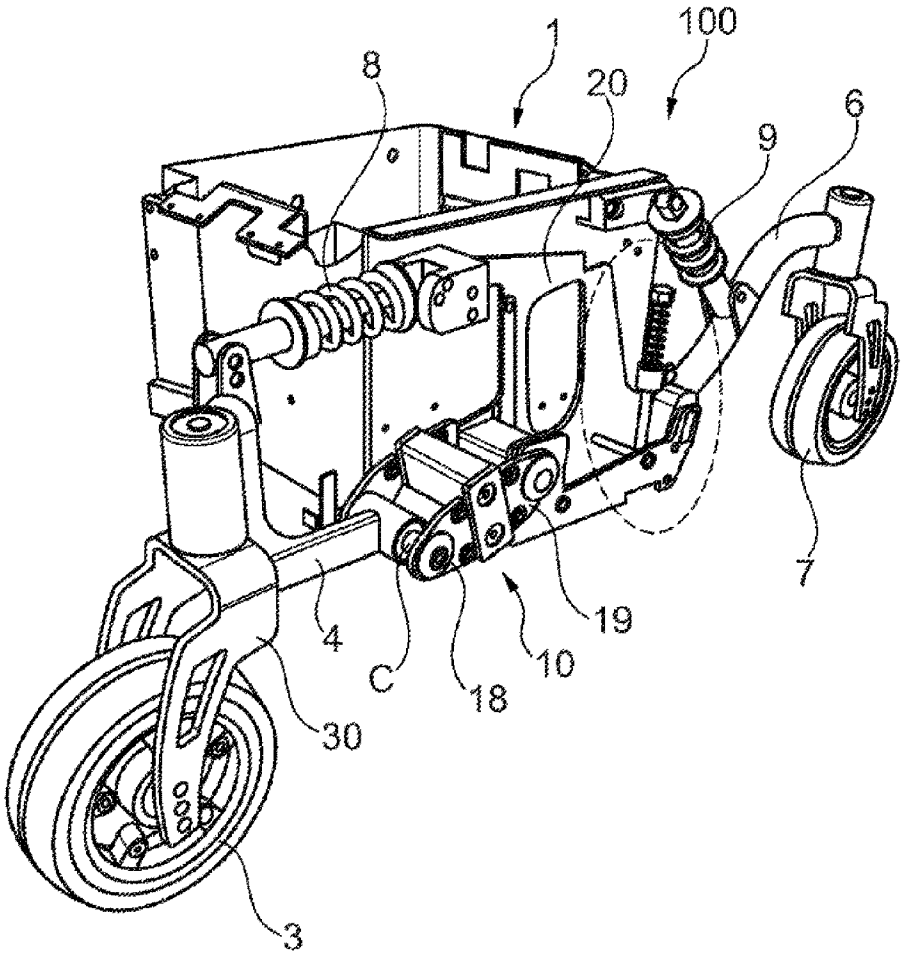
FIG. 6 is a first perspective part-illustration of the wheelchair.
Figure 10:
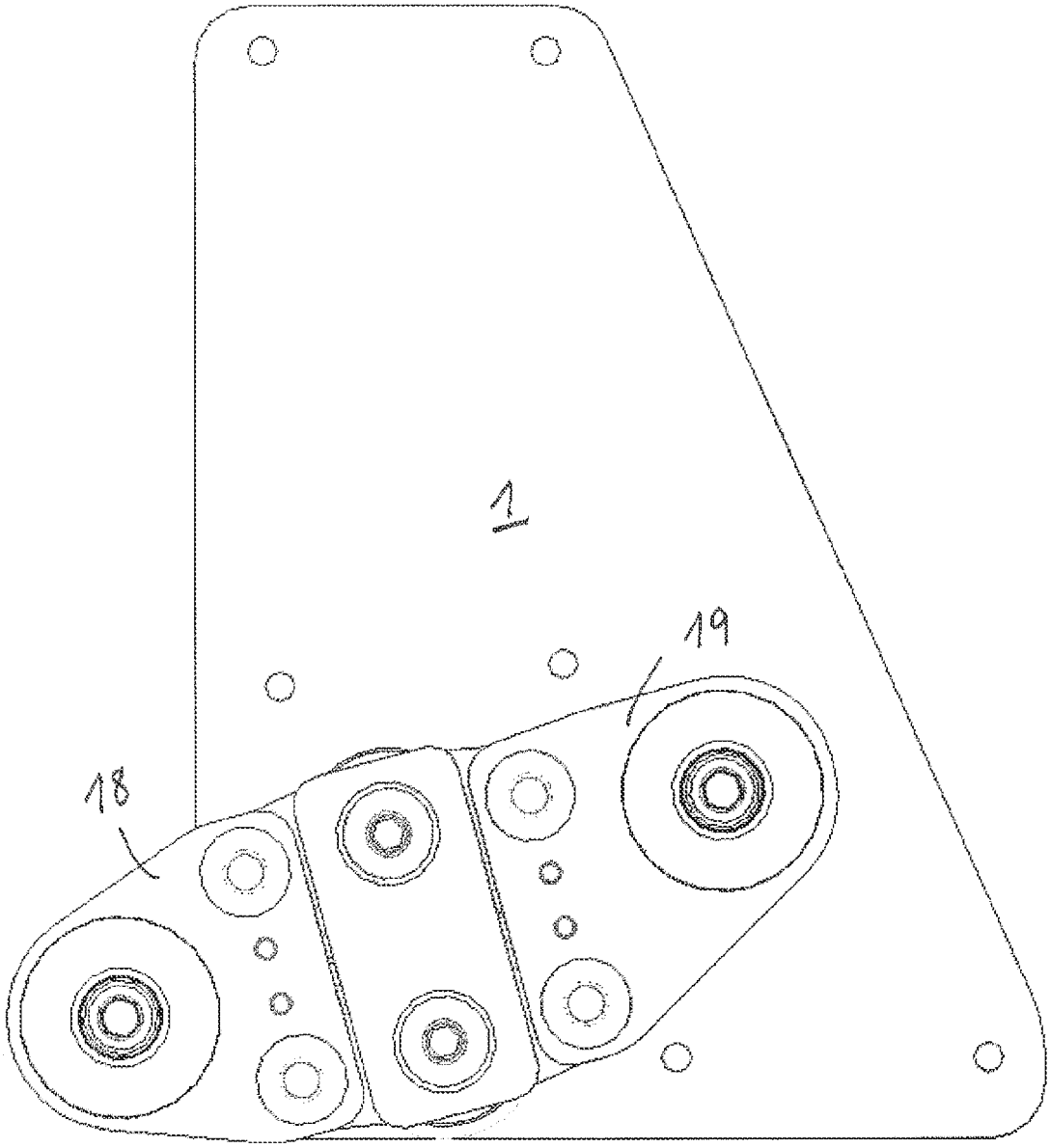
FIG. 10 is an enlarged part-illustration from FIG. 9.

The steering wheel 3 can, when driving over uneven surfaces, as formed, for example, by a pavement edge, be raised or lowered with respect to the carriageway F so that the drive wheel can then be raised from the wheel contact surface F (carriageway) (cf. FIGS. 2 and 4). In this instance, the swing arm 10 which is secured to the chassis 1 is rotated.

If the swing arm 10 is rotated about the pivot axes A and B, there is formed a parallelogram by means of which the pivot axis C of the front pivot arm 4 and the pivot axis D of the drive unit 20 change their vertical and horizontal position relative to the chassis.

The swing arm 10 is, as illustrated in FIGS. 6 to 9, securely screwed by means of two bolts 16', 17' to the chassis 1, wherein a first pivot axis A is formed by the first bolt 16' and a second pivot axis B is formed by the second bolt 17'. By means of a front bolt 18' which is arranged on the swing arm 10, the front pivot arm 4 is pivotably arranged about a third pivot axis C and, by means of a bolt 19' on the rear end of the swing arm 10, the drive unit 20 on which a pivot arm 23 is formed is pivotably supported about the pivot axis B.

Figure 11:
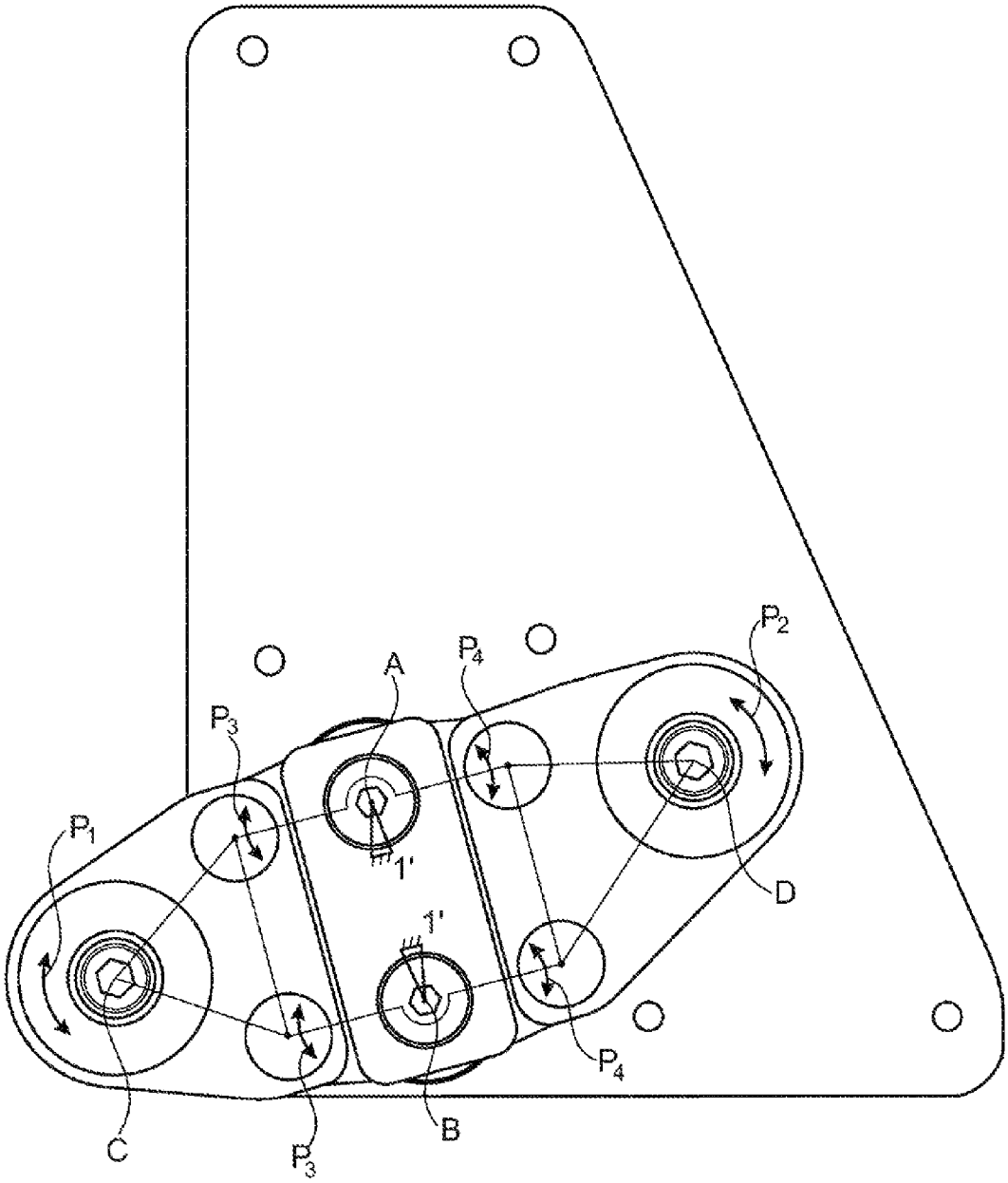
FIG. 11 shows the illustration according to FIG. 10 with explanations.

FIG. 11 shows the movements of the pivot axes A, B, C, D which are connected to each other by means of the parallelogram depicted. As a result of the construction, the pivot axes C and D move on a circular path. The radius of the circular path is approximately 26 mm. The movements are indicated by the arrows $P_1$, $P_2$, $P_3$, $P_4$. The fixed bearings 1' indicated illustrate the fixed connection of the swing arm 10 to the chassis 1.

Figure 11A:
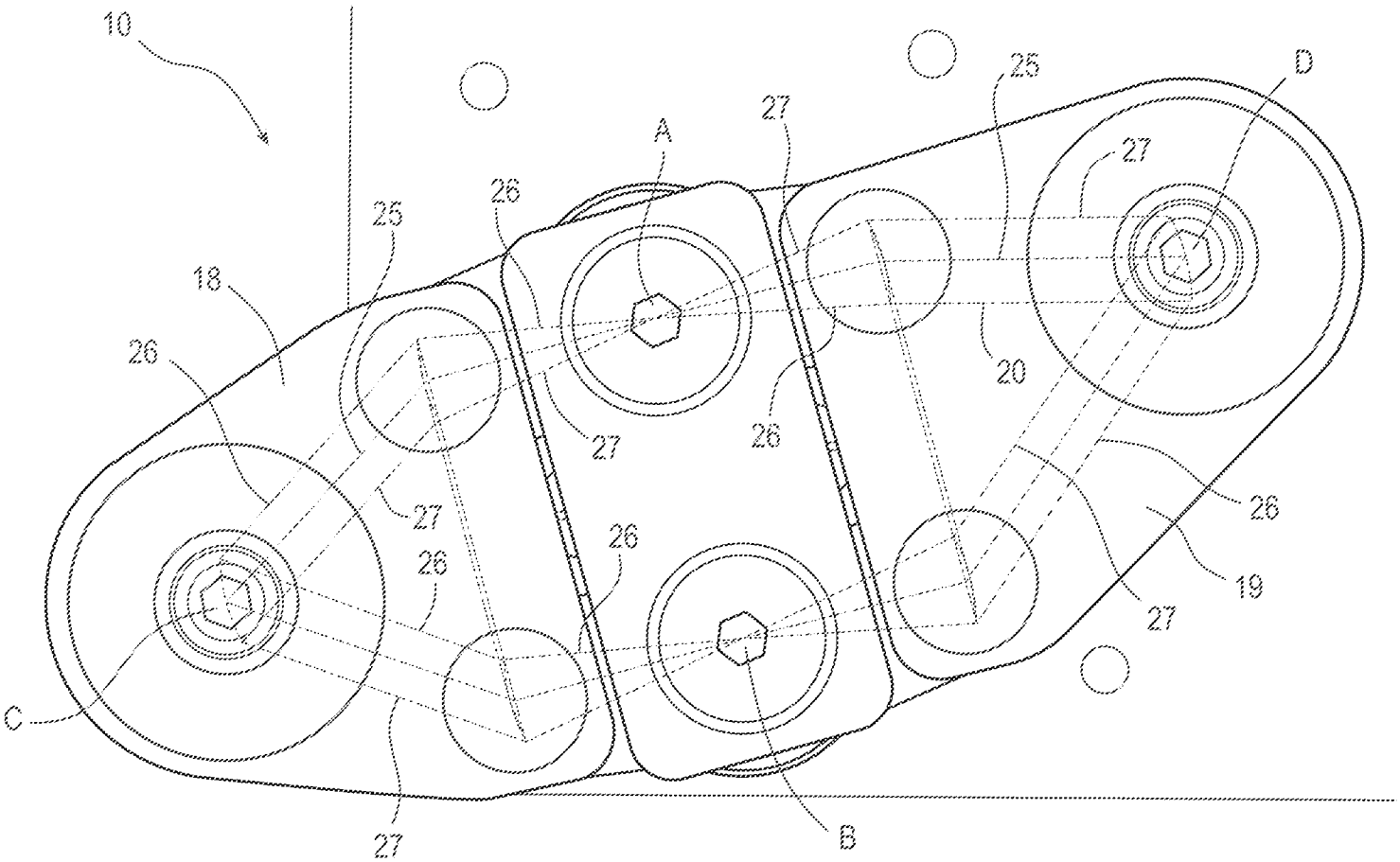
FIG. 11*a* is an enlarged illustration of the spring and/or damper unit.

FIG. 11*a* shows the situation of the swing arm 10 in different pivot positions. A central position 25 is illustrated by means of the central linear construct, by means of which the pivot axes A, B, C and D are connected to each other. The connection lines 26 and 27 connect the different axes when the swing arm 10 is pivoted through ±10°. This leads to a displacement of the pivot axes C and D which are not indicated separately.

Figure 11B:
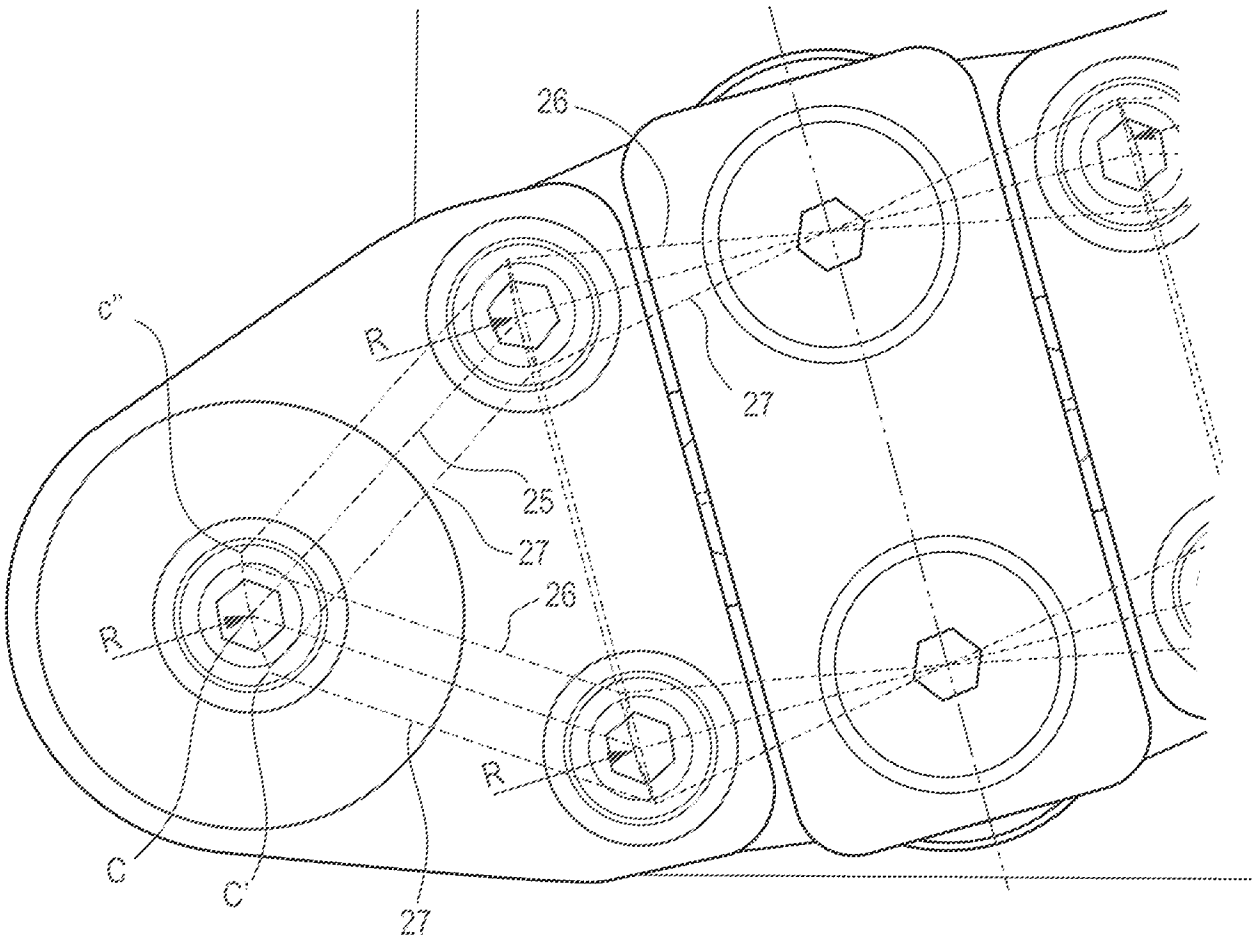
FIG. 11*b* is an enlarged cut-out of FIG. 11*a;*
Figure 12:
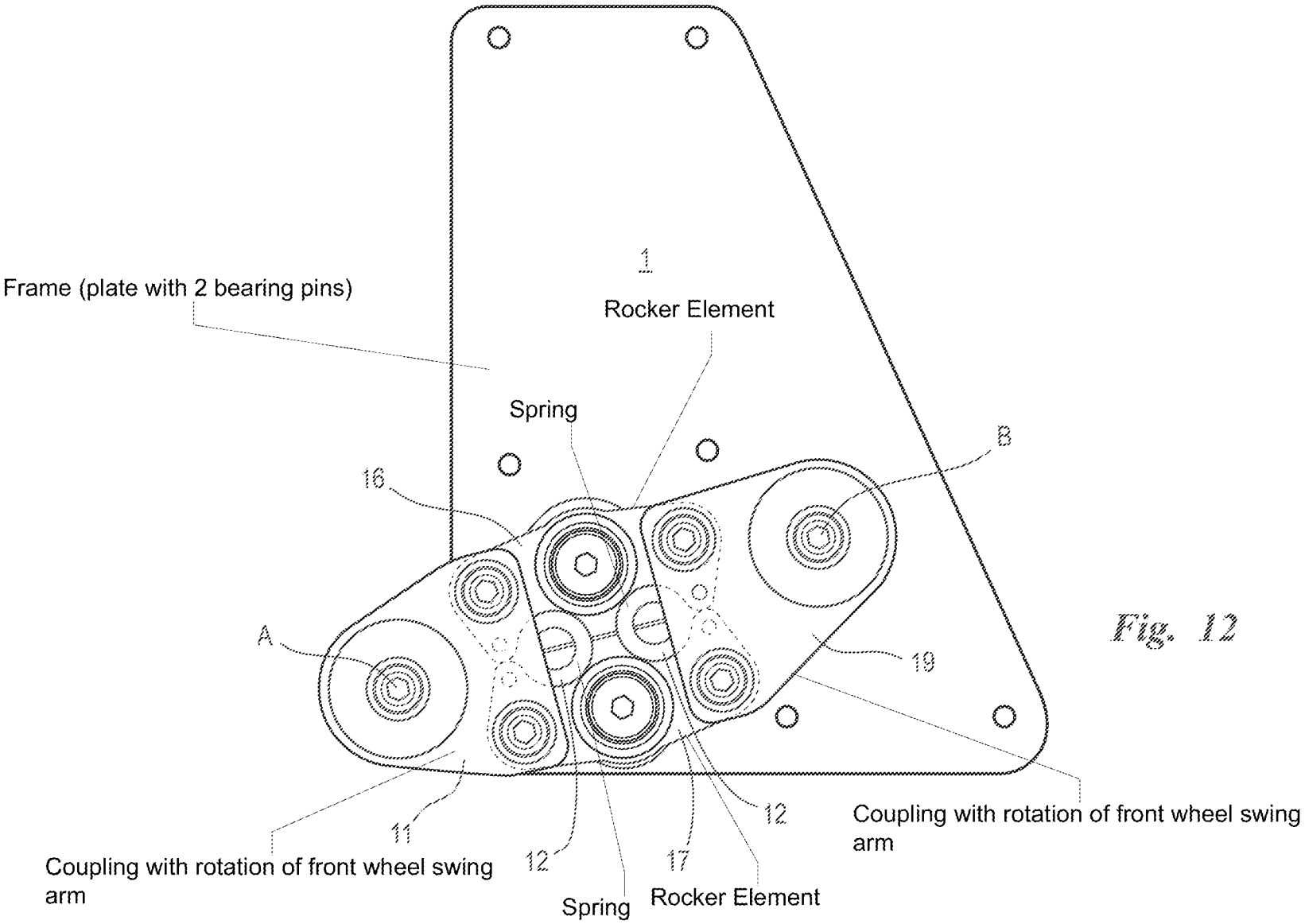
FIG. 12 shows the illustration according to FIG. 10 in a partially cut-away state.
Figure 13:
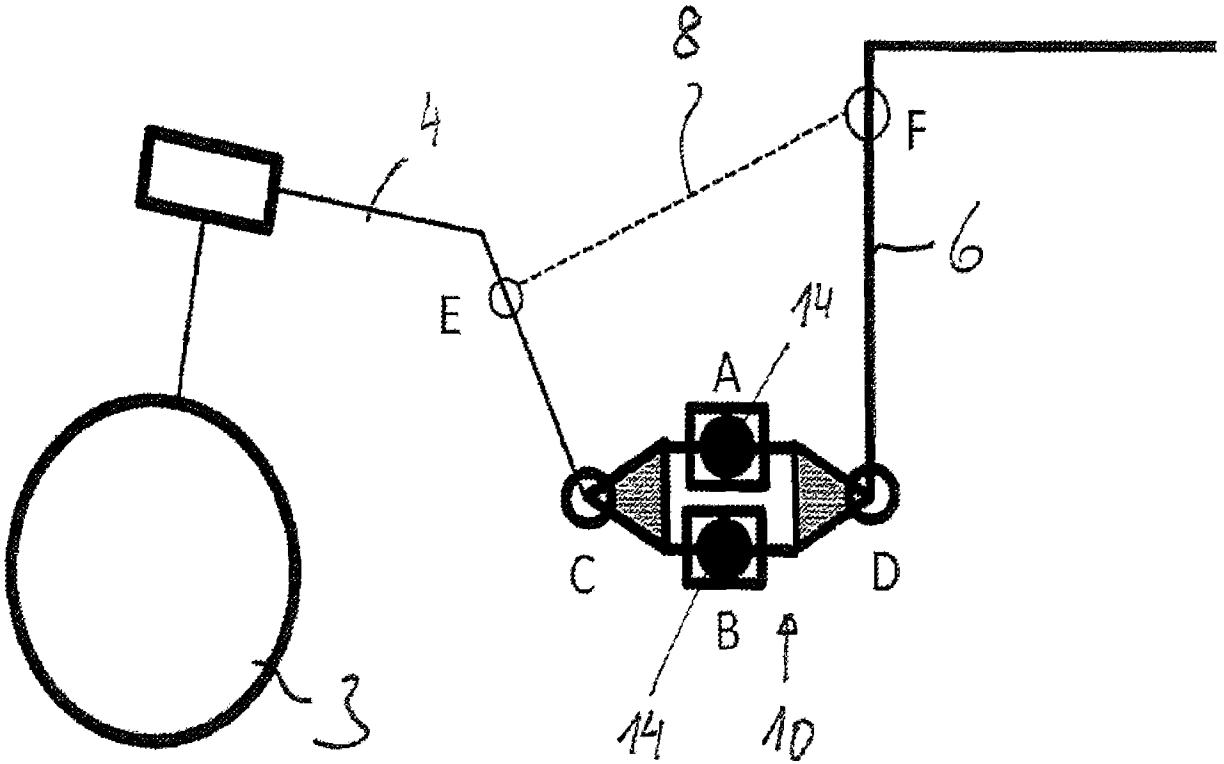
FIG. 13 is a schematic drawing.
Figure 14:
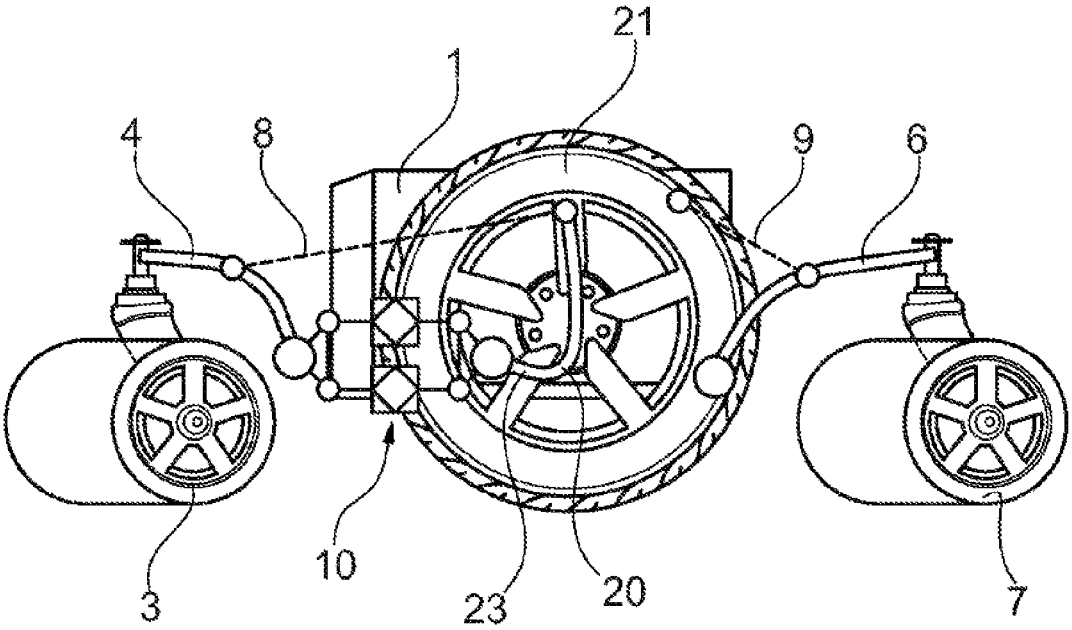
FIG. 14 is another schematic drawing.

FIG. 11*b* illustrates an enlarged cut-out from which it can be seen that the pivot axis C when pivoted through ±10° is pivoted to the positions C' and C". This takes place along a circular path with a radius R which is identical for all pivot axes.

Figure 15:
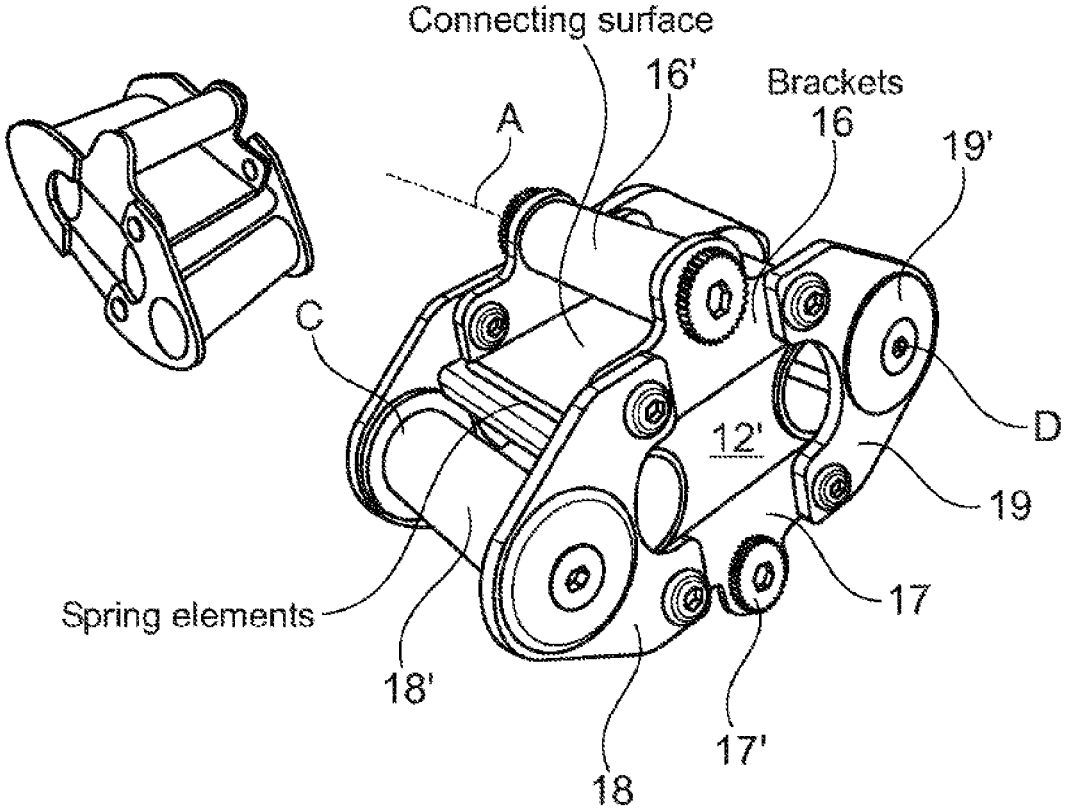
FIG. 15 is a perspective illustration of the swing arm in a first embodiment.
Figure 16:
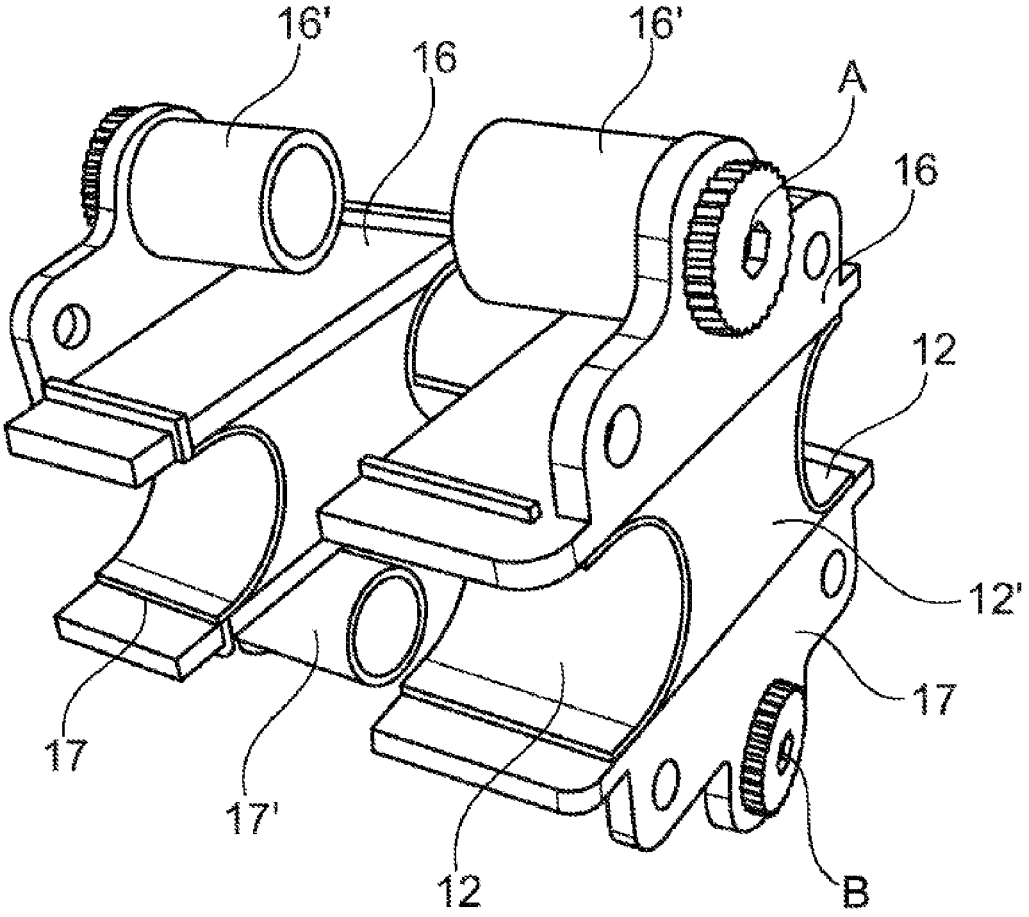
FIG. 16 is a perspective illustration of the swing arm in a second embodiment.

FIGS. 15 and 16 show a first embodiment of the swing arm 10. This swing arm 10 comprises the two yokes 18 and 19 which are arranged opposite each other and which each comprise two substantially triangular plates which are each connected to each other by means of a bolt 18', 19'. The pivot axes C and D are formed in the bolts 18', 19'. The triangular plates 18, 19 which are located opposite each other in a parallel manner are each screwed to an upper plate 16 and a lower plate 17. The two upper plates 16 are screwed to each other by means of a bolt 16' and the two lower plates 17 are screwed to each other by means of a bolt 17'. The bolts 16', 17' are securely arranged on the chassis 1 and form the pivot axes A and B. The upper plate 16 and the lower plate 17 are connected by means of two springs 12 which comprise an elastomer material and which are formed on a base member 12'. These springs 12 act in the manner of a torsion spring when pivot movements are introduced via the front steering wheel 3 into the front pivot arm 4 or via the drive wheel 21 into the drive unit 20.

The system operates with a redirection/rotation of the upper and lower plates 16, 17 from +10° to −10°.

Figure 17:
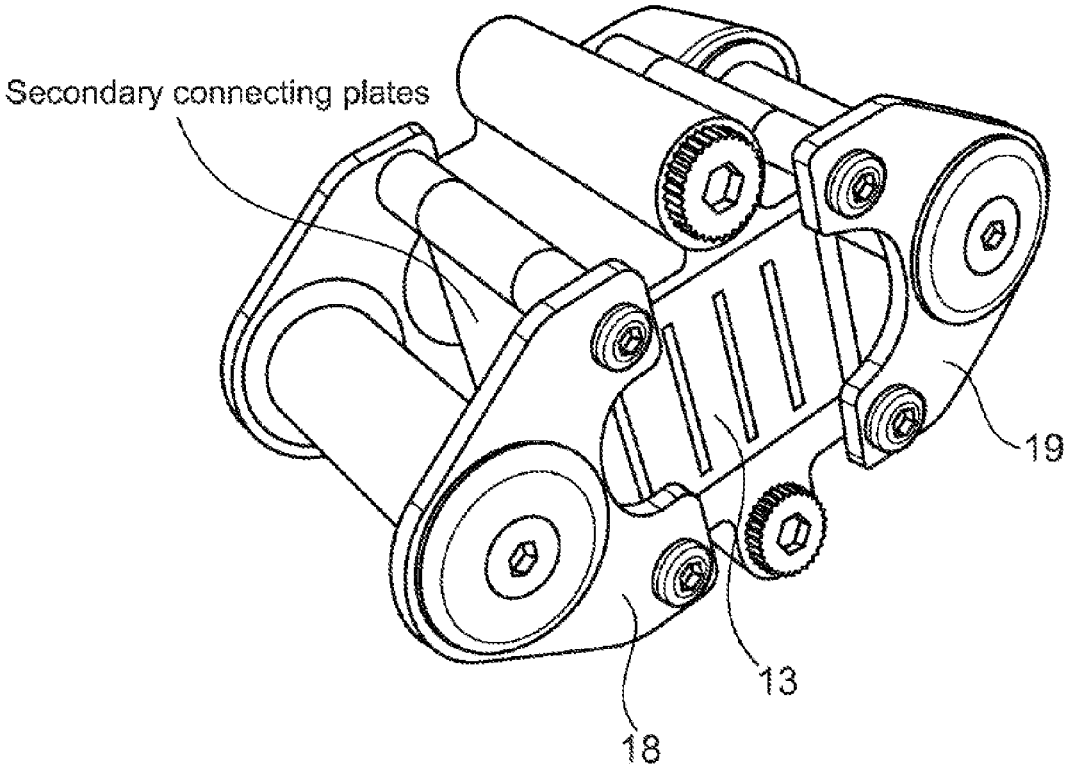
FIG. 17 is the perspective illustration of the swing arm in a third embodiment.
Figure 18:
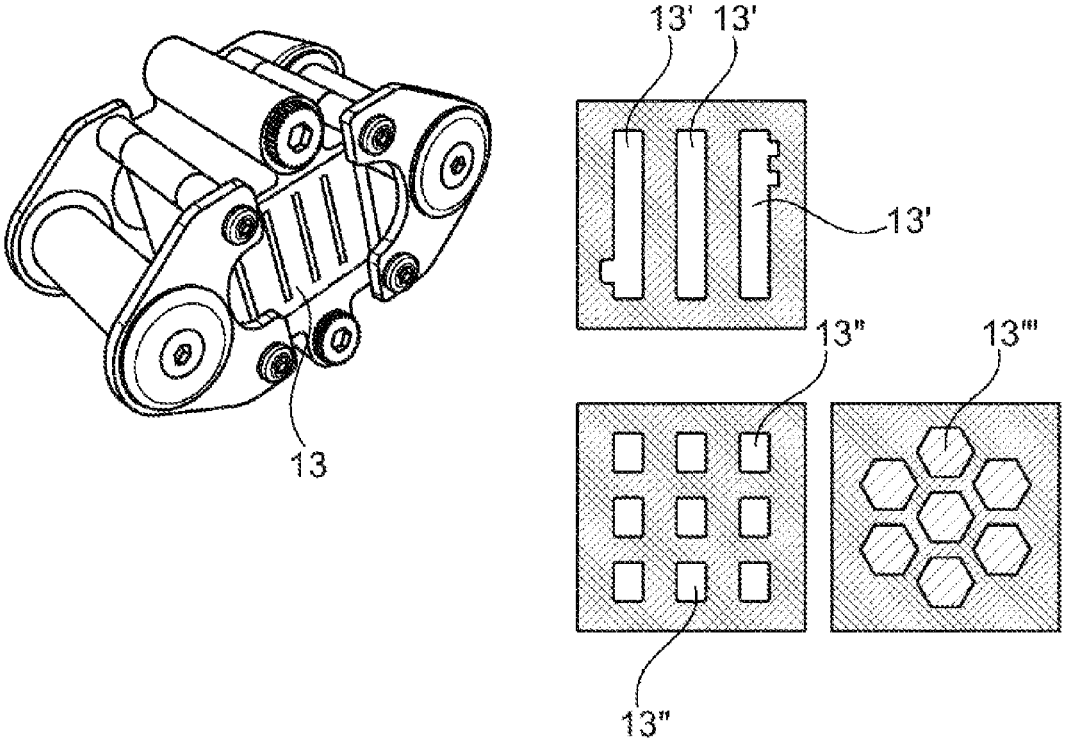
FIG. 18 is the illustration of the swing arm according to FIG. 13 with additional schematic depictions.

An alternative embodiment of an element 13 which comprises an elastomer material is shown in FIGS. 17 and 18. In order to produce the torsion spring, the block-like base member is provided with slots 13' or with recesses 13". The cross-sectional shape of the recesses 13", 13'" is possible in different variations. As a result of an appropriate selection of the slots 13' and/or recesses 13", 13'" and the cross-sectional shape thereof, the spring rate of the elastomer element 13 can be adjusted.

Figure 19:
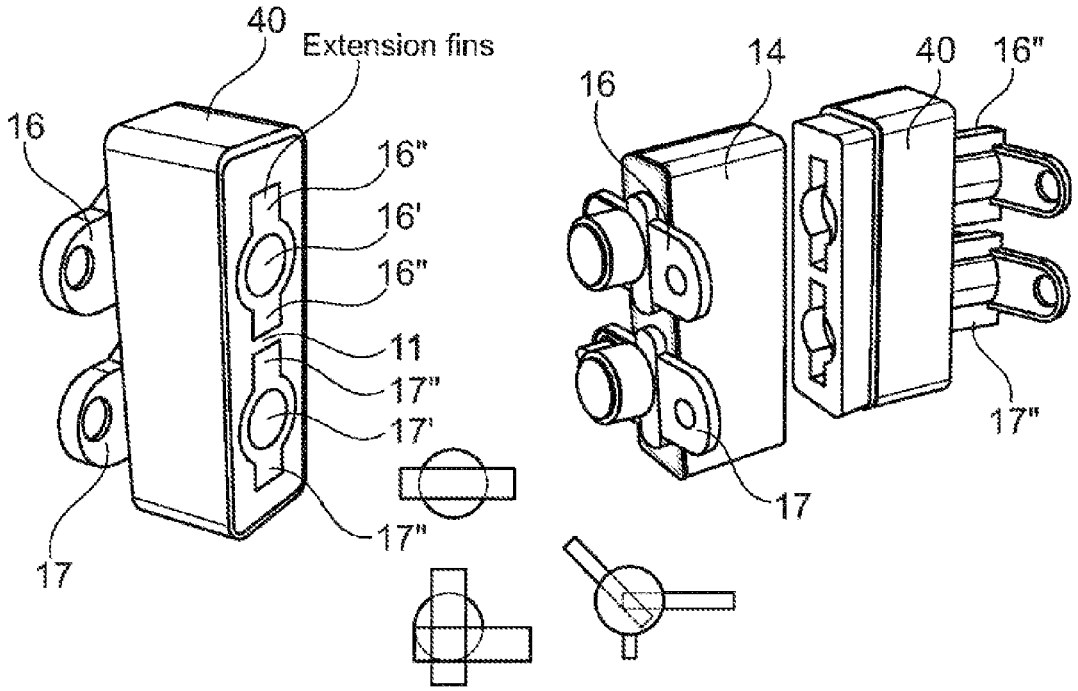
FIG. 19 is a perspective, partial illustration of the third embodiment of a swing arm.
Figure 20:
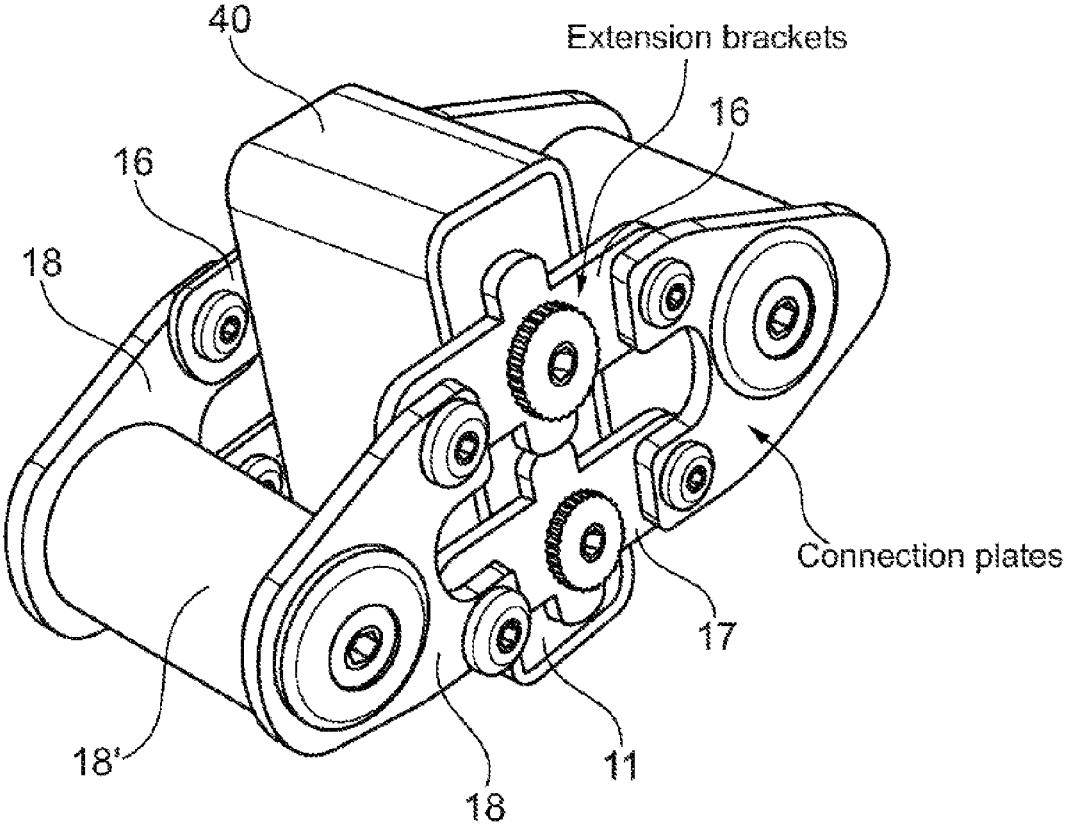
FIG. 20 is an illustration which corresponds to FIG. 19.

A third alternative for the construction of a torsion spring is shown in FIGS. 19 and 20. In this instance, the upper plate 16 and the lower plate 17 are pivotably supported in an elastomer element 11 which is surrounded by a housing 40. The upper plates 16 and lower plates 17 can rotate about the pivot axes A, B through a predetermined angle. In order to prevent over-rotation, the bolts 16', 17' are provided with projections 16", 17" which are arranged diametrically relative to each other on the bolts 16', 17' and whose outer spacing with respect to each other is greater than the width of the housing 40 so that, when excessively high forces are introduced, they strike the inner wall of the housing 40 and are blocked in terms of a further pivot movement.

The invention claimed is:

1. A wheelchair comprising:

a chassis on which there are arranged opposite each other:

at least one drive unit having a drive wheel and an electric drive;

a front wheel arranged on a front pivot arm;

a rear wheel;

wherein the drive unit and the front pivot arm are pivotably arranged in a vertical plane relative to the chassis and are connected to each other by a first coupling member and a second coupling member, wherein the second coupling member is a swing arm which is secured to the chassis pivotably about a first pivot axis and a second pivot axis, and in which the front pivot arm is pivotably supported about a third pivot axis and the drive unit is pivotably supported about a fourth pivot axis.

2. The wheelchair as claimed in claim 1, wherein at least one of the front wheel and the rear wheel is a steering wheel.

3. The wheelchair as claimed in claim 1, wherein the second coupling member is at least one of a spring and a damper unit.

4. The wheelchair as claimed in claim 3, wherein the third pivot axis is arranged lower with respect to a substrate on which the wheels are standing than the fourth pivot axis.

5. The wheelchair as claimed in claim 1, wherein the first coupling member is at least one of a spring and a damper unit.

6. The wheelchair as claimed in claim 1, wherein the first and second pivot axes are located on a notional line which extends in an inclined manner with respect to a vertical direction at an angle of up to 45°.

7. The wheelchair as claimed in claim 6, wherein the third pivot axis is arranged at one side of the notional line, and the fourth pivot axis is arranged at an opposite side of the notional line.

8. The wheelchair as claimed in claim 1, wherein the swing arm is formed by two opposing yokes which are connected to each other by at least one upper plate which receives the first pivot axis and at least one lower plate which receives the second pivot axis.

9. The wheelchair as claimed in claim 8, wherein each yoke is formed by two plates which are arranged in parallel and which are connected to each other by a bolt.

10. The wheelchair as claimed in claim 9, wherein each plate is connected to an upper plate and a lower plate and the upper plates are connected by a first bolt and the lower plates are connected by a second bolt.

11. The wheelchair as claimed in claim 10, wherein the first and second bolts have at least two diametrically arranged projections.

12. The wheelchair as claimed in claim 11, wherein the projections are embedded in a resilient element which comprises an elastomer material.

13. The wheelchair as claimed in claim 8, wherein the upper plates and the lower plates are resiliently supported in a housing which is secured to the chassis.

14. The wheelchair as claimed in claim 13, wherein the upper plates are connected to the lower plates by at least one element which comprises an elastomer material.

15. The wheelchair as claimed in claim 8, wherein the upper plates are resiliently connected to the lower plates.

16. The wheelchair as claimed in claim 15, wherein the upper plates are connected to the lower plates by at least one resilient element.

17. The wheelchair as claimed in claim 16, wherein the at least one resilient element is a torsion spring.

18. The wheelchair as claimed in claim 16, wherein the upper plate is connected to the lower plate by two resilient elements.

19. The wheelchair as claimed in claim 18, wherein a first of the two resilient elements is arranged in the region of the third pivot axis and a second of the two resilient elements is arranged in the region of the fourth pivot axis.

20. The wheelchair as claimed in claim 1, wherein the rear wheel is arranged on a rear pivot arm which is pivotably connected to the chassis.

21. The wheelchair as claimed in claim 20, wherein a third connecting member is arranged between the rear pivot arm and the chassis.

22. The wheelchair as claimed in claim 20, wherein the rear pivot arm and the drive unit move independently of each other.

23. The wheelchair as claimed in claim 1, wherein resilient elements are provided in the swing arm at an articulation location of the front pivot arm.

24. The wheelchair as claimed in claim 1, wherein resilient elements are arranged in the swing arm at an articulation location of the drive unit.

25. The wheelchair as claimed in claim 1, wherein resilient elements surround the first and second pivot axes.

26. The wheelchair as claimed in claim 1, further comprising a seat.

27. The wheelchair as claimed in claim 1, wherein a pivot arm is attached to the drive unit.

* * * * *